US006773004B2

(12) United States Patent
Obregon et al.

(10) Patent No.: US 6,773,004 B2
(45) Date of Patent: Aug. 10, 2004

(54) METHODS AND APPARATUS TO ESTIMATE THE THICKNESS OF A SHEET STACK

(75) Inventors: Roberto Obregon, Guadalajara (MX); Ricardo Ramirez, Guadalajara (MX); Gerardo Baldini, Guadalajara (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/313,481

(22) Filed: Dec. 6, 2002

(65) Prior Publication Data

US 2004/0108644 A1 Jun. 10, 2004

(51) Int. Cl.[7] ..... B65H 37/04

(52) U.S. Cl. ..... 270/58.09; 399/410; 227/5; 271/220

(58) Field of Search ..... 270/58.08, 58.09; 271/220, 259, 262, 258.05; 399/410; 227/2, 5

(56) References Cited

U.S. PATENT DOCUMENTS

| | | | | | |
|---|---|---|---|---|---|
| 4,318,555 | A | * | 3/1982 | Adamski et al. | 227/7 |
| 4,852,867 | A | * | 8/1989 | Johdai et al. | 270/58.09 |
| 4,878,656 | A | * | 11/1989 | Honjo et al. | 270/58.09 |
| 5,056,774 | A | * | 10/1991 | Kubota et al. | 271/213 |
| 5,110,102 | A | | 5/1992 | Suzuki | |
| 5,187,534 | A | * | 2/1993 | Iwata et al. | 399/410 |
| 5,346,204 | A | * | 9/1994 | Endoh et al. | 271/294 |
| 5,462,265 | A | | 10/1995 | Mandel | |
| 5,464,201 | A | | 11/1995 | Deen | |
| 5,478,062 | A | * | 12/1995 | Horiuchi et al. | 270/58.08 |
| 5,599,009 | A | | 2/1997 | Mandel | |
| 5,676,367 | A | * | 10/1997 | Oshino et al. | 271/212 |
| 5,685,536 | A | | 11/1997 | Barthold | |
| 5,810,348 | A | * | 9/1998 | Scheufler | 271/213 |
| 5,961,115 | A | * | 10/1999 | Blanck et al. | 271/263 |
| 6,196,542 | B1 | | 3/2001 | Allmendinger | |
| 6,279,899 | B1 | * | 8/2001 | Coffey et al. | 271/220 |
| 6,302,389 | B1 | * | 10/2001 | Kato et al. | 270/58.13 |
| 6,305,681 | B1 | | 10/2001 | Watanabe | |
| 6,367,793 | B1 | | 4/2002 | O'Dea | |

FOREIGN PATENT DOCUMENTS

| | | | | | |
|---|---|---|---|---|---|
| JP | 63235259 | A | * | 9/1988 | B65H/37/04 |
| JP | 01236165 | A | * | 9/1989 | B65H/37/04 |
| JP | 02089771 | A | * | 3/1990 | B65H/37/04 |
| JP | 02233296 | A | * | 9/1990 | B42C/1/012 |
| JP | 04089294 | A | * | 3/1992 | B42C/1/12 |
| JP | 05050781 | A | * | 3/1993 | B42C/1/12 |
| JP | 11301919 | A | * | 11/1999 | B65H/37/04 |

* cited by examiner

*Primary Examiner*—Patrick Mackey

(57) ABSTRACT

A finishing device which is configured to receive sheets of imaging media, forming a sheet stack, from an imaging apparatus includes a sheet stack tray to support the sheet stack. The finishing device also includes a sheet stack hold-down device which is operable from a first position to a variable second position. When the hold-down device is in the second position it presses the sheet stack against the sheet stack tray. The finishing device further includes a sensor which can detect the position of the sheet stack hold-down device when it is in the second position, to thereby provide an approximation of the thickness of the sheet stack, based on the then-current second position of the hold-down device.

29 Claims, 8 Drawing Sheets

METHODS AND APPARATUS TO ESTIMATE THE THICKNESS OF A SHEET STACK

BACKGROUND

Methods and apparatus described herein are useful in imaging apparatus having post-imaging finishing devices. The term "imaging apparatus" includes devices such as printers, photocopies and facsimile machines, which form an image on one or more sheets of imaging media (as for example, paper, transparencies, cardstock, envelopes, etc.). A post-imaging finishing device is a device which works in conjunction with the imaging apparatus to apply "finishing" to the sheets of imaged media. The post-imaging finishing device can be integral with the imaging apparatus, or it can be separate device which can be attached to the imaging apparatus, or placed in imaging-media communication with the imaging apparatus (i.e., imaged sheets of imaging media from the imaging apparatus can be provided to the finishing device for post-imaging finishing). The finishing device can include one or more post-imaging finishing units. A common finishing unit is a stapler (or "stapling unit") which staples together sheets of imaging media that have been deposited into a stack (the "sheet stack"). Other examples of finishing units include: a sheet binding unit which adheres the sheets of imaged media in a sheet stack to one another together along a common edge of the sheet stack by applying a glue or resin along the edge; a stitching unit which stitches together the sheets of imaged media in a sheet stack along a common edge; and a hole punch unit that punches one or more holes in the sheets of a sheet stack. The operation performed by a finishing unit in a finishing device will be known herein as a "post-imaging finishing process" or a "finishing process".

Many post-imaging finishing processes (stapling, binding, stitching, hole-punching, etc.) are limited by the thickness of the sheet stack, such that the process cannot or should not be applied to the sheet stack once the stack exceeds a certain thickness. This limitation typically is based on the capacity of the finishing unit. For example, in a stapling unit the limitation can be set by the height of a the staple (or staples) available to the stapling unit, such that the staple is of insufficient length to pass through all of the sheets in the sheet stack and still have sufficient excess length to cleat-over on the last page of the stack (thus binding the stack together into a cohesive stapled set). Further, a stapling unit limitation can be set by the cross-sectional area, and/or the material of fabrication, of the available staple(s), such that a staple will tend to buckle when driven into a sheet stack of more than a certain thickness. A stapling unit limitation can also be set by the power available to the stapler, such that the stapler may have insufficient power to drive a staple through the entire sheet stack. Similarly, in a stitching unit and/or a hole-punch unit, the limitation of the unit can be set by the power available to the unit, such that there is insufficient power for the respective awl and/or punch to penetrate all pages in the sheet stack. In an edge binding unit, glue is applied by an applicator of a certain height, and in this instance the limitation can be set by that height, such that the height of the applicator is insufficient to include all of the sheets in the sheet stack.

When a post imaging finish process is attempted to be provided to a sheet stack which exceeds the capacity of the finishing unit, deleterious results can occur. In the simplest case, the finishing process is not applied to all of the sheets in the sheet stack, in which case a user can choose to either accept an undesirable product, or must reapply or complete the finishing process by other means. Furthermore, attempting to apply a finishing process to a sheet stack when the thickness of the stack exceeds the capacity of the finishing unit can result in a damaged sheet stack, as for example can occur when a staple buckles in the sheet stack. In more serious cases, the finishing unit itself can be damaged when attempting to apply a finishing process to a sheet stack when the thickness of the stack exceeds the capacity of the finishing unit.

One prior art method of estimating the thickness of a sheet stack is to count the number of sheets placed in the sheet stack using a sheet counter (a device that counts sheets as they exit the imaging section of an imaging apparatus and are placed in the output tray). When the counted number of sheets exceeds a pre-set number, the finishing unit can be disabled, since it will be anticipated that more sheets that the pre-set number will exceed the capacity of the finishing unit. However, this method is based on a preselected paper thickness, which is typically the thickness of the thickest paper likely to be encountered. The method suffers from the fact that the thickness of the sheets are not always the same as the estimated sheet thickness. For example, an imaging apparatus can be configured to process sheets having industry-standard weights of from 18 pounds to 32 pounds. (Paper "weight" is based on 500 sheets of the paper, each sheet having a width of 17 inches and a length of 22 inches.) In general, paper thickness is proportional to paper "weight", such that a sheet of 32-pound paper will be about 78% thicker than a sheet of 18-pound paper. Accordingly, the method is configured to anticipate that the heaviest (thickest) paper will be used. When thinner paper than the heaviest anticipated paper is used, the finishing unit will be disabled when, in fact, the capacity of the finishing unit (based on the estimated overall thickness of the sheet stack) has not yet been exceeded.

SUMMARY

One non-limiting embodiment of the present invention provides for a finishing device which is configured to receive sheets of imaging media forming a sheet stack. The finishing device can receive the sheets from an imaging apparatus, for example. The finishing device includes a sheet stack tray to support the sheet stack, and a sheet stack hold-down device which is operable from a first position to a variable second position. When the hold-down device is in the second position it presses the sheet stack against the sheet stack tray. The finishing device further includes a sensor which can detect the position of the sheet stack hold-down device when it is in the second variable position, thereby providing an approximation of the thickness of the sheet stack based on the actual second position of the hold-down device.

Another embodiment of the invention provides for a method of controlling operation of a finishing unit. The method includes providing a sheet stack made up of sheets of imaging media, and holding the sheet stack against a surface with a sheet stack hold-down device. The position of the sheet stack hold-down device is detected, and the detected position of the sheet stack hold-down device is then used to control operation of the finishing unit.

These and other aspects and embodiments of the present invention will now be described in detail with reference to the accompanying drawings, wherein:

DETAILED DESCRIPTION

Selected embodiments of the present invention use a sheet stack hold-down device, in conjunction with a sensor, to estimate the thickness of a sheet stack. In one embodiment a finishing device, which is configured to receive sheets of imaging media forming a sheet stack, includes a sheet stack tray configured to support the sheet stack. The finishing device also includes a sheet stack hold-down device which is operable from a first position to a variable second position. In the second position the sheet stack hold-down device presses against the sheet stack. The variability of the second position is thus dependent on the thickness of the sheet stack. The finishing device also includes a sensor which can detect the position of the sheet stack hold-down device when it is in the then-current second position. By sensing the then-current position of the hold-down device, the sensor thus senses the approximate thickness of the sheet stack. The finishing device can further include a finishing unit (such as a stapling unit or the like) which is configured to apply a post-imaging finishing process (for example, a stapling process) to the sheet stack. In this case, in response to detecting the approximate thickness of the sheet stack based on the position of the hold-down device, the sensor can generate a sheet stack thickness signal which can be used to control the finishing unit. For example, the signal can be used to disable the finishing unit. This and other embodiments of the invention will now be more particularly described.

Figure 1:
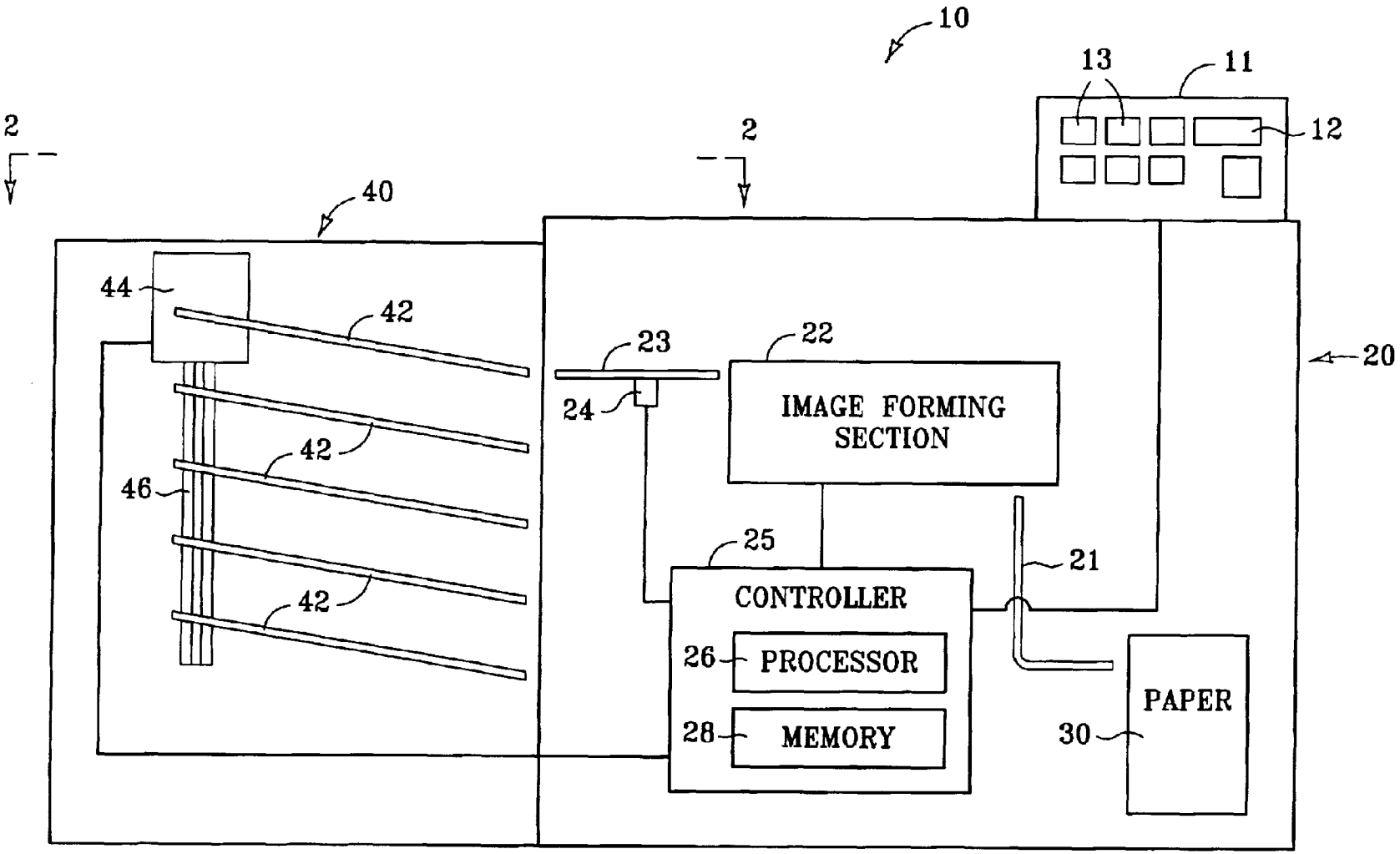
FIG. 1 is a side elevation schematic diagram depicting selected components of an imaging apparatus and a post imaging finishing device in accordance with selected embodiments described herein.

Turning to FIG. 1, a side elevation schematic diagram depicts selected components of an imaging apparatus 10 having an imaging section 20 and a post-imaging finishing device 40 attached to the imaging section 20. The imaging section 20 is configured to form an image on imaging media (such as paper 30) by moving the imaging media along a first paper path 21 to an image forming section 22, where an image can be generated onto the imaging media. The image forming section 22 can be, for example, a laser imaging section or an inkjet image forming section. Once imaged, the sheets of imaging media move along a secondary paper path 23 to the finishing device 40. The imaging section 20 can further include a controller section 25, which, as depicted, includes a processor 26 and a computer readable memory device 28 (such as RAM and/or ROM memory components). The controller 25 can be used to control operational functions of the imaging section 20, such as image generation by the image forming section 22 and communication with a user via a user interface 11. The user interface 11 can include user-input points (such as buttons or switches 13), as well as a user display 12 which allows the controller to display messages to a user. In the example depicted, the imaging section 20 also includes a sheet counting sensor 24, which is in signal communication with the controller 25, and which can be used to count the number of sheets of imaged media being transferred to the finishing device 40.

As depicted in FIG. 1, the finishing device 40 includes a plurality of sheet stack trays 42 upon which can be deposited sheets of imaged media from the imaging section 20. The finishing device further includes a finishing unit 44, which can be, for example, a stapling unit, an edge binding unit, a stitching unit, or a hole punch unit. In the example shown, the finishing unit 44 can travel vertically along a guide 46 so that a single finishing unit can be used to service all of the trays 42. The finishing device 40 is further provided with a sheet stack hold-down device, which is not depicted in FIG. 1 but is depicted in subsequent figures, which will now be described.

It will be appreciated that the imaging apparatus 10 of FIG. 1 can be an integral, self-contained apparatus, or it can be a two-part apparatus, in which event the finishing device 40 can be separable from the imaging section 20.

Figure 2:
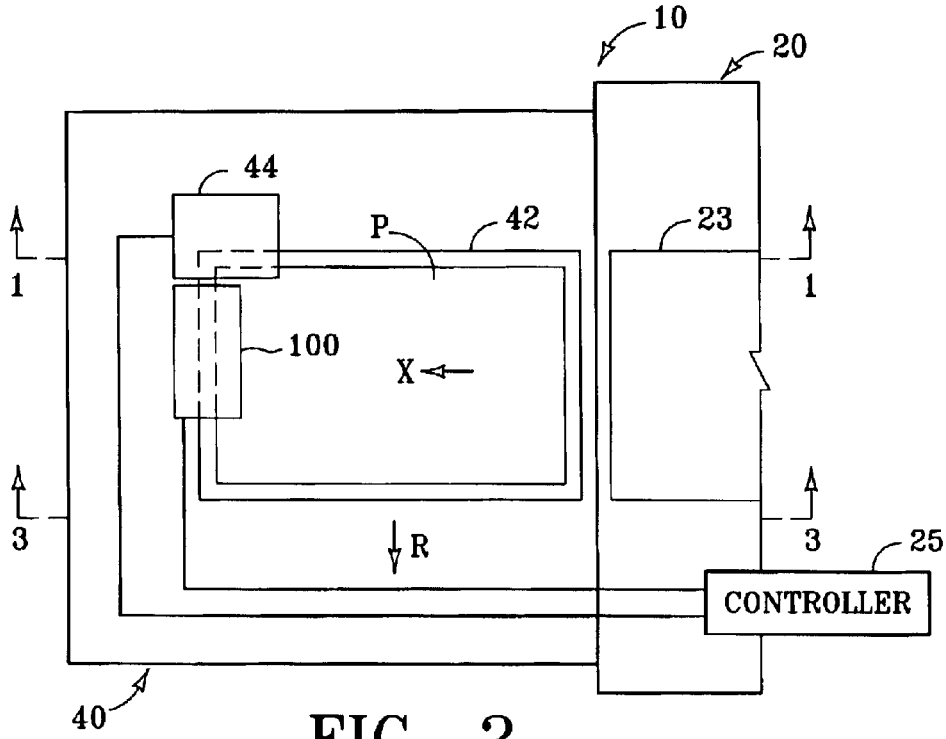
FIG. 2 is a partial plan view of the imaging apparatus and post imaging finishing device depicted in FIG. 1.

Turning now to FIG. 2, a partial plan view depicts the imaging apparatus 10 and the post imaging finishing device 40 of FIG. 1. In FIG. 2 the paper path 23 from the imaging section 20 which feeds sheets of imaged media to the finishing device 40 can be seen. Imaging media (paper "P") is moved in direction "X" from the output paper path 23 onto the tray 42. Sheets of imaging media "P" can accumulate on the tray 42 to form a sheet stack. A sheet stack hold-down device 100 is provided to hold the sheet stack together as each new sheet "P" is deposited onto the sheet stack. The operation of the sheet stack hold-down device 100 will be described more fully below. The finishing unit 44 can apply post-imaging finishing to the sheet stack, as described above. Both the finishing unit 44 and the hold-down device 100 can be controlled by the controller 25.

Figure 3:
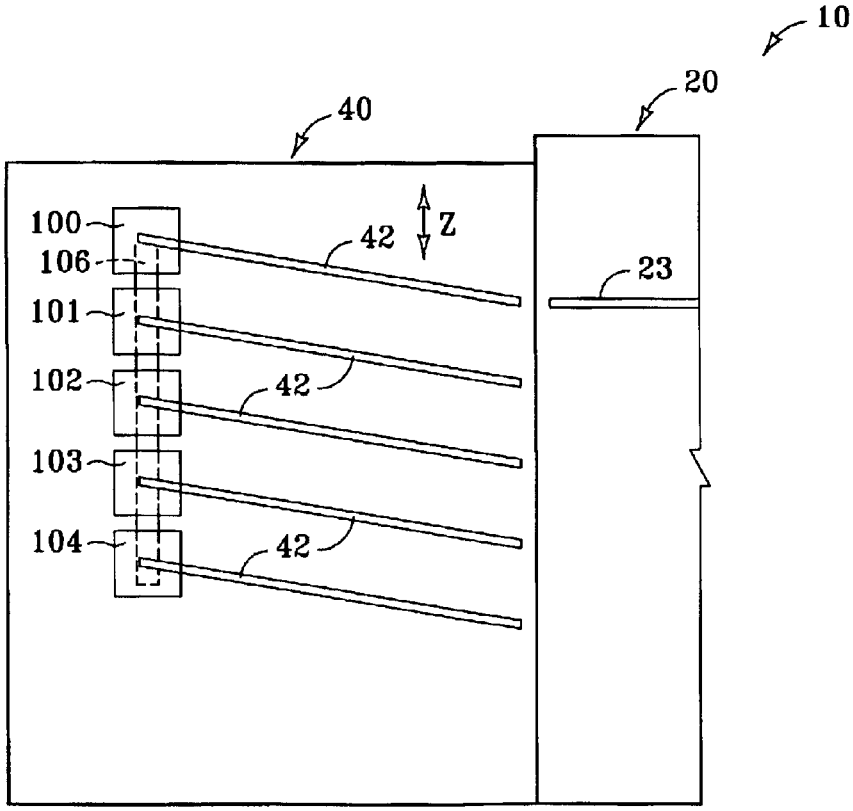
FIG. 3 is a partial side elevation sectional view of the imaging apparatus and post imaging finishing device depicted in FIG. 2.

Turning now to FIG. 3, a partial side elevation sectional view of the imaging apparatus 10 and post imaging finishing device 40 depicted in FIG. 2 is shown. FIG. 3 depicts how the finishing device 40 can be provided with a single sheet stack hold-down device 100 which can move in direction "Z" along guide rail 106 to thereby allow a single hold-down device to service all of the sheet stack trays 42. Alternately, each tray 42 can be provided with a dedicated sheet stack hold-down device, indicated by hold-down devices units 100, 101, 102, 103 and 104.

Figure 4:
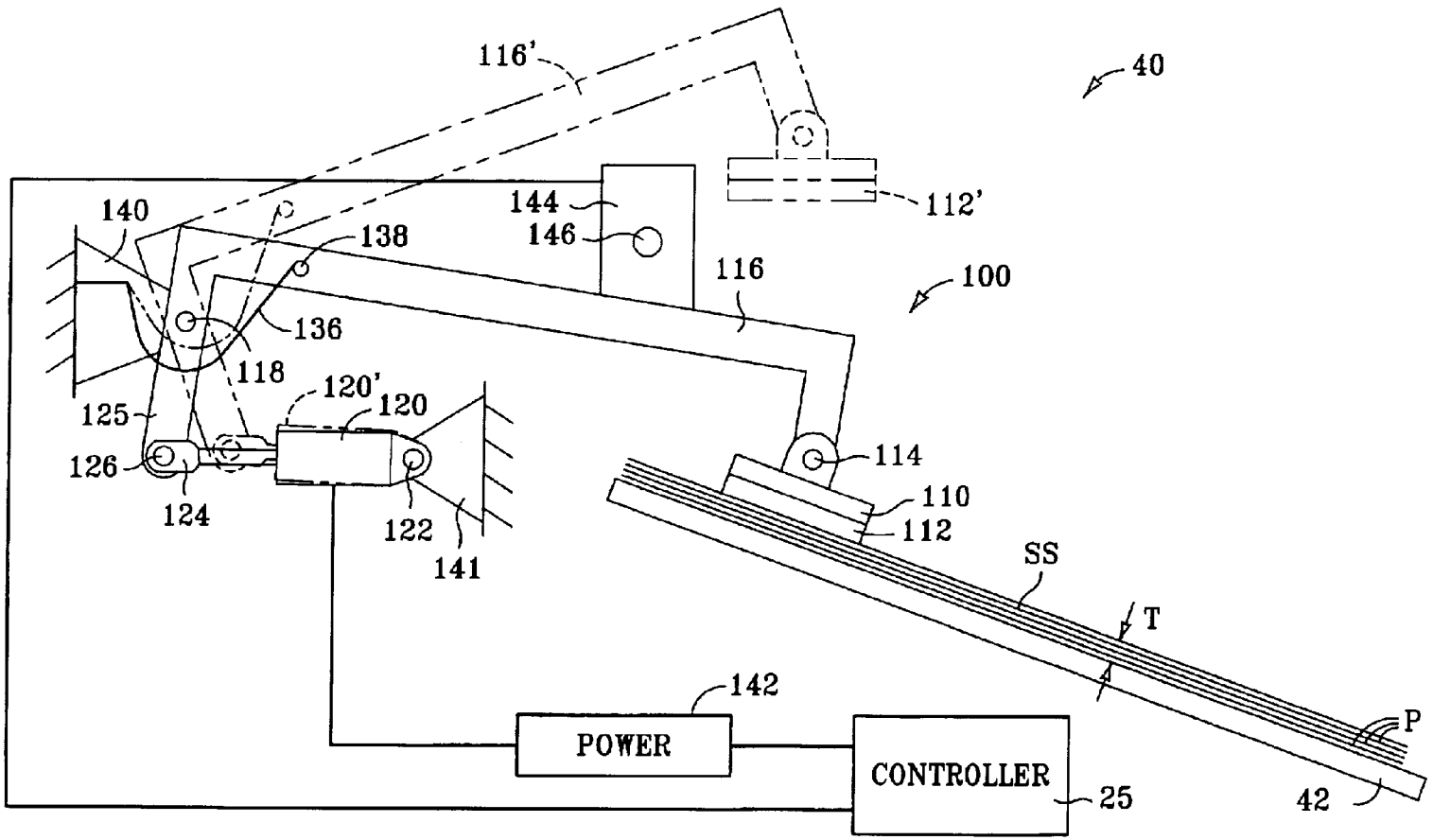
FIG. 4 is a side elevation diagram depicting details of the post imaging finishing device depicted in FIGS. 2 and 3.

FIG. 4 is a side elevation diagram depicting details of the post imaging finishing device 40 depicted in FIGS. 2 and 3, and in particular, the sheet stack hold-down device 100. A sheet stack "SS", which is composed of a number of sheets of imaging media "P", is shown as being supported on a sheet stack tray 42. In the example depicted, the sheet stack hold-down device 100 includes a pad 112 which is configured to press against the sheet stack SS. The pad 112 is supported by an arm 116, by way of a pad support 110, at a first end of the arm. A rotatable pad connector 114 allows the pad 112 to rotate with respect to the arm 116 so that the pad can maintain full contact with the sheet stack "SS". Although the pad 112 is depicted as being a flat member, it will be appreciated that the pad can be any configuration which contacts the uppermost sheet of the sheet stack "SS" and presses the sheet stack against the tray 42. For example, the "pad" 112 can be a bar, one or more fingers, or one or more rollers. The arm 116, which in this example is L-shaped, is pivotally supported by a frame member 140 at arm pivot connection 118. A second end 125 of the arm 116 is connected to an actuator 120 via an actuator connector member 124 and a pivot-connection pin 126. The actuator 120 can be actuated by a power source 142, which can in turn be controlled by the controller 25. A return spring 136 is positioned between the frame member 140 and a pin 138 on the arm 116. The return spring 136 biases the arm 116, and thus the pad 112, into the position depicted by solid lines in FIG. 4.

In operation, the sheet stack hold-down device 100 is operable from a first position (indicated by phantom lines of arm 116' and pad 112') to a variable second position (indicated by solid lines of arm 116 and pad 112). In the first position the pad 112' of the sheet stack hold-down device 100 is retracted away from the sheet stack "SS", and in the second position the pad 112 presses the sheet stack "SS" against the sheet stack tray 42. The sheet stack hold-down device 100 can be selectively cycled between the first and second positions by the controller 25 and the actuator 120. Actuator 120 can be pivotally supported by a frame member 141 by actuator pivot connection 122 to introduce compliance into the sheet stack hold-down device 100 so that when the arm 116' is in the first position, the actuator 120 can move to the position indicated by phantom lines 120' to prevent binding of the arm 116 and the actuator 120.

Typically, the hold-down device 100 is in the first (or retracted) position as a new sheet of imaging media is added to the sheet stack "SS", or as the leading edge of a sheet being newly added to the stack approaches the pad 112. Once a sheet of imaging media has been added to the sheet stack "SS", the hold-down device 100 is cycled to the second position so that the hold-down device can hold the sheets of imaging media (which constitute the sheet stack "SS") into a generally cohesive stack, thus reducing loft between the sheets and resisting movement of the sheets within the stack. If post-imaging finishing is to be applied to the sheet stack "SS" by a finishing unit (e.g., finishing unit 44 of FIG. 2), then the hold-down device 100 can continue to hold the sheets together in the second position to facilitate operation of the finishing unit. Once post-imaging finishing is applied, or the imaging job has been completed (even if post-imaging finishing is not to be applied), then the controller 25 can retract the hold-down device 100 to the first position (indicated by phantom arm 116' and pad 112') to facilitate removal of the sheet stack "SS" from the tray 42 (as indicated by directional arrow "R" in FIG. 2).

The second position of the sheet stack hold-down device 100 (i.e., when the pad 112 contacts the sheet stack "SS") is variable in that as the thickness "T" of the sheet stack increases as new sheets are added to the stack, the pad 112 and arm 116 will progressively move in a direction towards the first position (indicated by phantom pad 112' and arm 116').

The finishing device 40 further includes a sensor 144, which can detect the then-current position of the sheet stack hold-down device 100 when the hold-down device is in the second position. Based on the detected position of the hold-down device, the approximate thickness "T" of the sheet stack "SS" can be determined. In response to detecting the position of the sheet stack hold-down device 100, the sensor 144 can generate a sheet stack thickness signal which can be used, as for example by the controller 25, to control the finishing unit 44 (FIG. 2). In the example depicted in FIG. 4 the sensor 144 detects whether the sheet stack hold-down device 100 is at or above a predetermined position, or whether the hold-down device is below the predetermined position. We will describe another embodiment below wherein a sensor can be used to detect the incremental position of the hold-down device in the second position.

Figure 5:
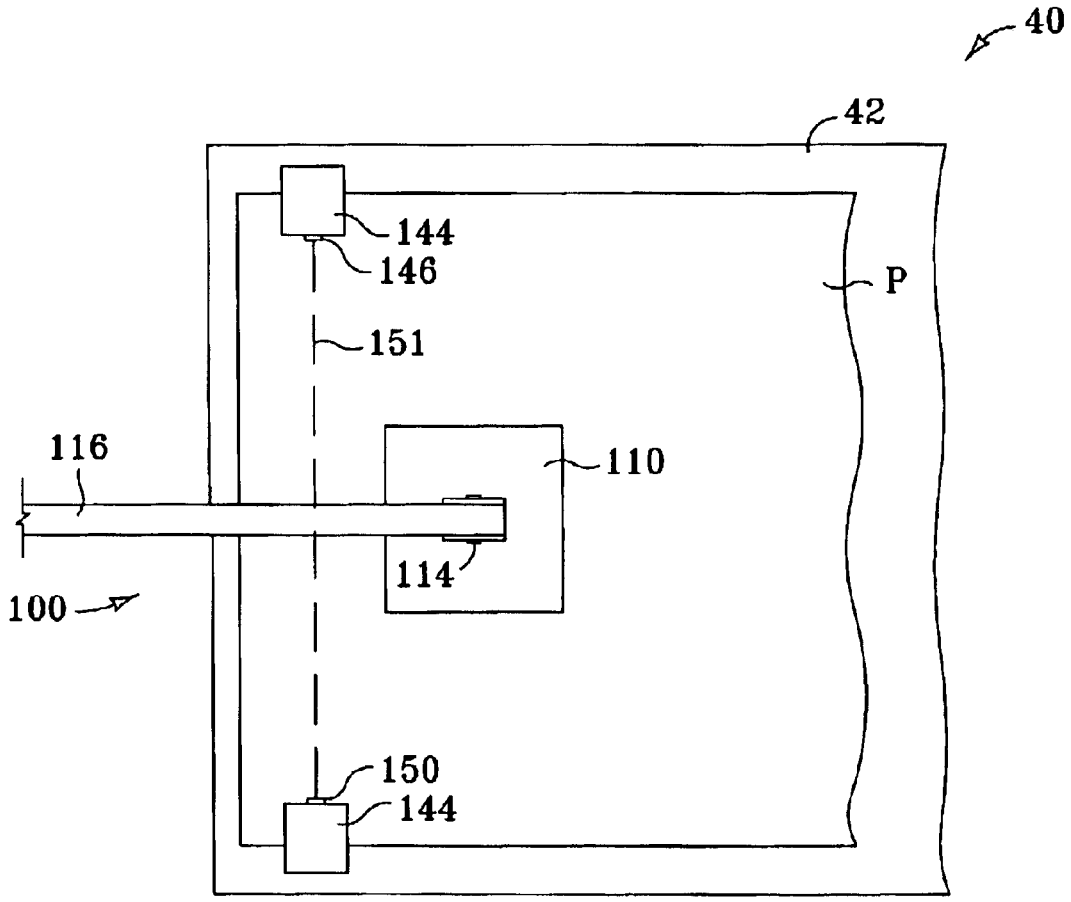
FIG. 5 is a partial plan view of the apparatus depicted in FIG. 4.

Turning to FIG. 5, a partial plan view of the sheet stack hold-down device 100 and the sensor 144 of FIG. 4 are depicted. In the example depicted the sensor 144 includes a light source 146 (such as a photoeye) and a photodetector 150, which are spaced-apart on either side of the arm 116. As the arm 116 moves upwards (towards position 116' of FIG. 4), the arm can intercept or block the light beam 151 generated by the light source 146 so that the photodector 150 will not be able to detect the beam 151. As an alternative to using the arm 116 to block the light source 146, the pad support 110 (as well as the pad 112, FIG. 4) can be used to block the light source 146.

Figure 6:
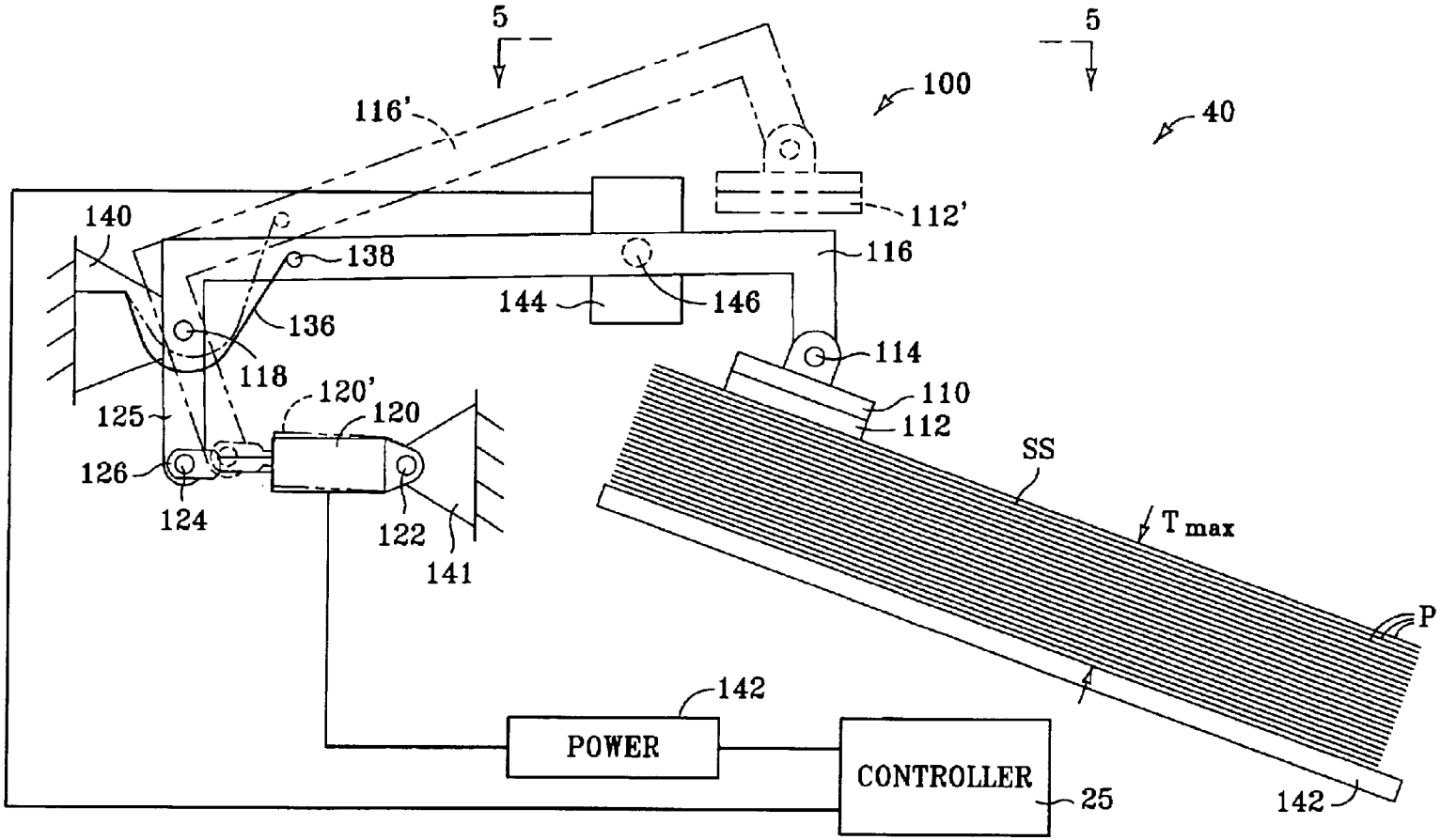
FIG. 6 is another side elevation diagram depicting details of the post imaging finishing device depicted in FIGS. 2 and 3, but with components moved to accommodate a thick sheet stack.
Figure 7:
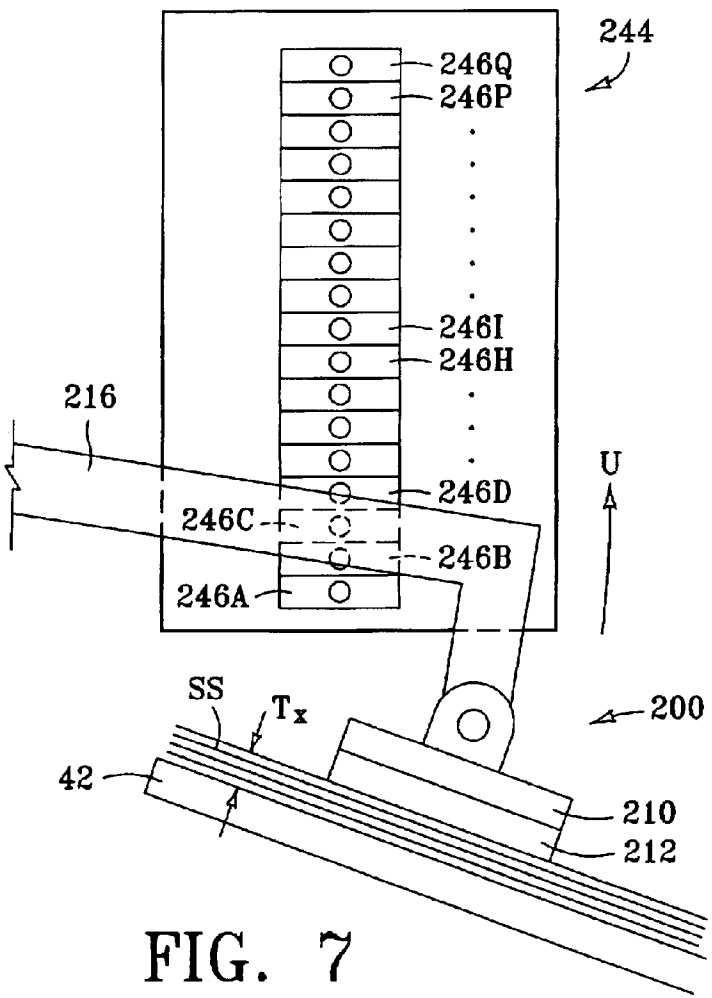
FIG. 7 is a side elevation view depicting selected components of a variation of the apparatus depicted in FIG. 4.

Turning to FIG. 6, another side elevation view of the hold-down device 100 is shown. FIG. 6 is similar to the view depicted in FIG. 6, but in FIG. 6 the hold-down device 100 (which is in the "second variable position") is depicted as engaging a sheet stack "SS" having a thickness of $T_{max}$. (The thickness "$T_{max}$" of the sheet stack "SS" in FIG. 7 is exaggerated for purposes of facilitating illustration of the operation of the hold-down device 100.) As can be seen, the arm 116 of the hold-down device 100 is blocking the light source 146 of the sensor 144 (and is also blocking the photodetector 150 of FIG. 5), so that the light beam (151, FIG. 5) cannot be detected by the photodetector. The position of the light source 146, and the shape of the arm 116, can be selected so that a predetermined value for "$T_{max}$" will cause the light source 146 (and the photodetector 150, FIG. 5) to be blocked by the arm 116. Once the light source 146 (and/or photodetector 150) is blocked by the arm 116, the photodetector 150 (FIG. 5) can generate a signal. The signal can be the discontinuance of a previous signal generated when the photodetector 150 receives the light beam 151. The signal can then be used by the controller 25 (FIG. 6) to control the finishing unit (44, FIG. 2). In one example, "$T_{max}$" can be identified as the sheet stack thickness at which the finishing unit (44, FIG. 2) should be disabled so that post-imaging finishing is not applied to the sheet stack. For example, if the finishing unit is a stapler, and it has been determined that the stapling process should not be applied to a sheet stack when the thickness of the sheet stack is "$T_{max}$" or greater, then when the thickness of the sheet stack "SS" reaches "$T_{max}$", the arm 116 will block the photodetector 150 (FIG. 5), thus generating a sheet stack thickness signal. The controller 25 (FIG. 4) can then use this signal to disable operation of the stapling unit.

Figure 8:
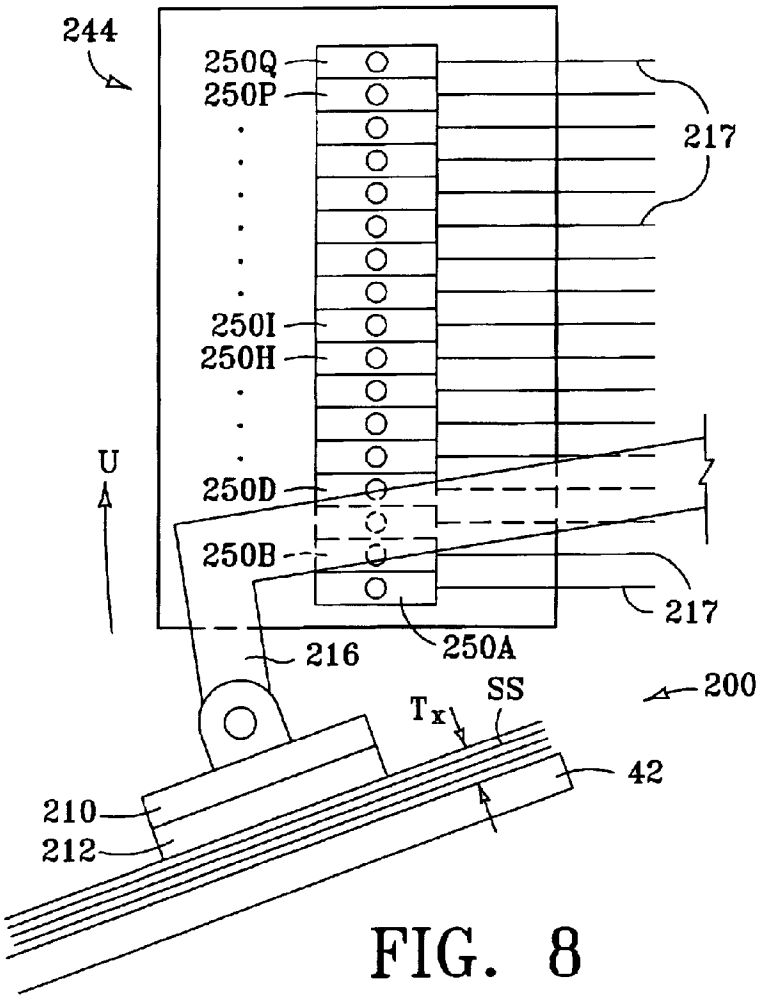
FIG. 8 is a side elevation view of the apparatus depicted in FIG. 7, but from the other side.

In another embodiment, rather than using the sheet stack thickness signal to selectively enable or disable the finishing unit, the finishing unit can be variably operable, in which case the sheet stack thickness signal can be used to variably operate the finishing unit. For example, if the finishing unit is a stapling unit having the capability to generate staples of different staple heights to accommodate sheets stacks of different thicknesses, then the sheet stack thickness signal can be used to facilitate selection of the staple height to be used to staple the sheet stack. Turning to FIG. 7, a side elevation sectional view of another sheet stack hold-down device 200 that can be used in a finishing device (such as finishing device 40 of FIG. 1) is depicted. The sheet stack hold-down device 200 can be similar to the sheet stack hold-down device 100 of FIG. 4 in all relevant aspects, and is used to hold down a sheet stack "SS" against a sheet stack tray 42. FIG. 8 should be viewed in conjunction with FIG. 7. FIG. 8 is side elevation sectional view depicting the sheet stack hold-down device 200 of FIG. 7, but in the opposite direction as the view seen in FIG. 7. The sheet stack hold-down device 200 includes a pad 212, a pad support 210, and an arm 216 which supports the pad 212. The hold-down device 200 is depicted as being in the second position, holding down the sheet stack "SS". As with the hold-down device 100 of FIG. 4, the hold-down device 200 of FIGS. 7 and 8 can have a variable second position, such that as the thickness "T," of the sheet stack "SS" increases, the pad 212, pad support 210, and arm 216 will progressively be moved upward in direction "U".

In the example depicted in FIGS. 7 and 8, rather than having a single sensor (such as sensor 144 of FIGS. 4 and 5), the finishing unit 200 of FIGS. 7 and 8 includes a sensor array 244 which includes a plurality of sensors. Each sensor can include a light source 246A through 246Q (FIG. 7) and an associated photodetector 250A through 250Q (FIG. 8). Each photodetector 250A–Q can be provided with a signal line 217, which can connect to the controller 25 (FIG. 1). In this configuration each of the light sources 246A through 246Q (and/or photodetectors 250A–Q) can be progressively blocked by the sheet stack hold-down device 200 as the sheet stack hold down device is progressively moved in direction "U" through the variable second position. As each light source 246A–Q and/or photodetector 250A–Q is progressively blocked, the associated photodetector 250A–Q can change signal state, so that a unique sheet stack thickness signal can be generated as each light source/photodetector is blocked. In this way, a variable sheet stack thickness signal can be generated, which can then be used by the controller (25, FIG. 1) to variably control a variably operable finishing unit. When the uppermost light source 246Q and/or photodetector 250Q is blocked by the arm 216 of the hold-down device, then the corresponding sheet thickness signal can be used to disable the finishing unit.

Figure 9:
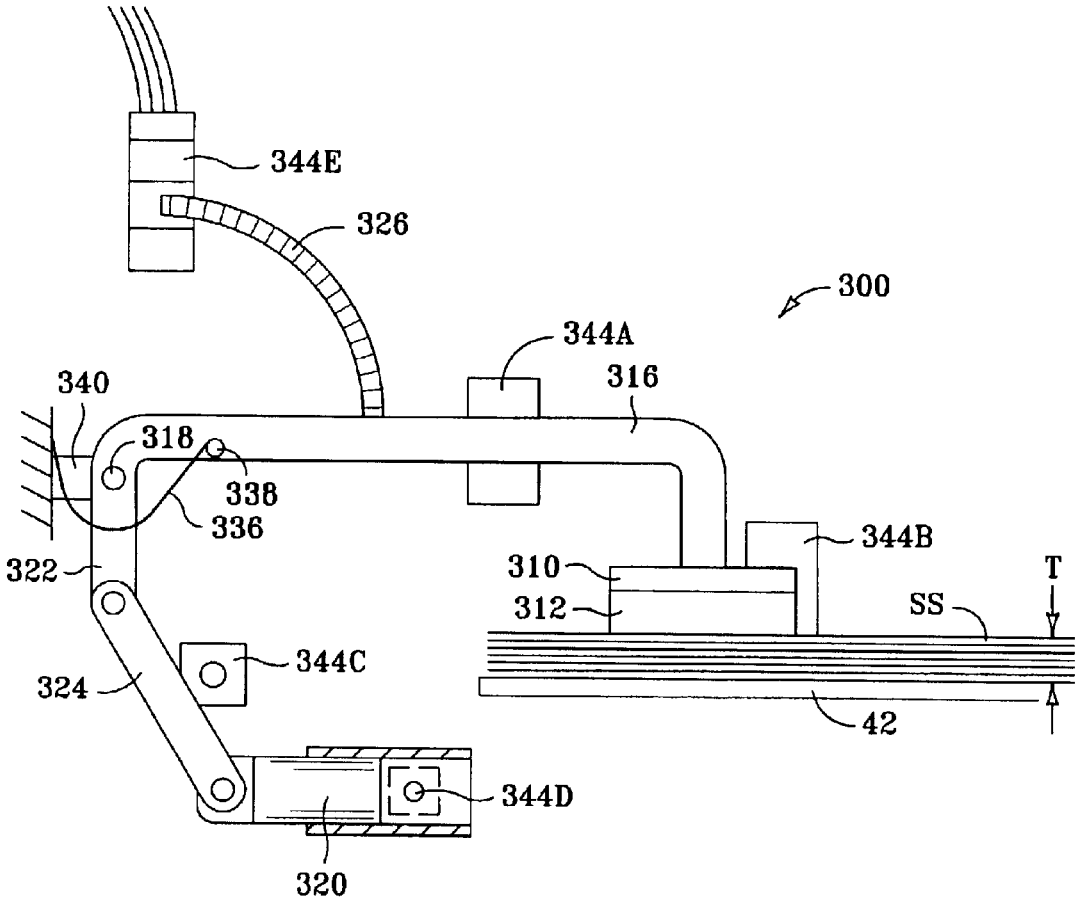
FIG. 9 is a side elevation diagram depicting details of another post imaging finishing device.

In the examples depicted in FIGS. 4 through 8 the sensor (144, 244) is depicted as being positioned so that the arm (116, 216) of the sheet stack hold-down device (100, 200) can block the photodetector of the sensor. However, other configurations can be employed. Turning to FIG. 9, a side elevation view depicts another sheet stack hold-down device 300 that can be used in a finishing device (e.g., finishing device 40 of FIG. 1). The sheet stack hold-down device 300 is similar in certain aspects to the hold-down device 100 of FIG. 4, in that the hold-down device 300 is used to hold a sheet stack "SS" of thickness "T" against a sheet stack tray 42. The sheet stack hold-down device 300 includes a pad 312 which is configured to press against the uppermost sheet of the sheet stack "SS" when the hold-down device is in a variable second position. Further, the sheet stack hold-down device 300 is configured to retract to a first position (similar to the position indicated by 116' in FIG. 4) so that additional sheets of imaging media can be added to the sheet stack "SS". The pad 312 is supported by a pad support 310, which is in turn supported by arm 316 at a first end of the arm. The arm 316 is pivotally connected to a frame member 340 by arm pivot connector 318. A spring member 336, which acts against pin 338 on arm 316, can be used to bias the arm 316 into the second position (as shown). Arm 316 can be selectively moved between the first position and the variable second position by actuator 320. One or more connecting links 324 can be used to connect a second end 322 of the arm 316 to the actuator 320.

In the configuration depicted in FIG. 9, the sensor which is used to detect the position of the hold-down device 300 when the hold-down device is in the second position can be located in a number of different places. Since each component (pad 312, pad support 310, arm 316, connecting link 324, and actuator 320) of the hold-down device 300 can potentially vary as the hold-down device variably moves through the second position, each of these components can potentially be used in conjunction with a sensor to provide an estimation of the thickness "T" of the sheet stack "SS". For example, sensor 344A can be used to detect the position of the arm 316 in the second position, similar to sensor 144 of FIG. 4. Further, sensor 344B can be used to detect the position of the pad 312 and/or the pad support 310, sensor 344C can be used to detect the position of the connector link 324, and sensor 344D can be used to detect the position of the actuator 320. When the sensor 344A, 344B, 344C or 344D includes a light source and a photodetector (similar to light source 146 and photodetector 150 of FIG. 5), then the respective hold-down component (arm 316, pad 312, pad support 310, connector link 324, or actuator 320) can block the light source and/or photodetector when the sheet stack hold down device is in a predetermined second position. Each sensor 344A–D can thus generate a sheet thickness signal, which can be used by the controller (25, FIG. 1) to control the operation of a finishing unit (e.g., finishing unit 44 of FIG. 1). Further, rather than using a single sensor in each location for each of sensors 344A–D, a sensor array (similar to sensor array 244 of FIGS. 7 and 8) can be used to allow the controller (25, FIG. 1) to variably control a variably controllable finishing unit.

In addition to placing a sensor relative to one of the primary components of the sheet stack hold-down device (e.g., arm 316, pad 312, pad support 310, connector link 324, or actuator 320 of hold-down device 300, FIG. 9), a secondary component can be attached to one of the primary components of the hold-down device and used in conjunction with a sensor. For example, as depicted in FIG. 9, an extension member 326 can be connected to the arm 316. In this case sensor 344E can be provided (which can include a light source and a photodetector), such that the extension member 326 can block the light source and/or the photodetector when the sheet stack hold down device 300 is in the predetermined second position.

It will be appreciated that the sheet stack hold-down devices 100 (FIGS. 4–6), 200 (FIGS. 7 and 8), and 300 (FIG. 9) depicted in the indicated figures are exemplary only, and that other configurations can be used to achieve the same function of indicating sheet stack thickness in conjunction with a sheet stack hold-down device and a sensor. In general, any sheet stack hold-down device which can variably move through a hold-down position as a function of sheet stack thickness, and which has one or more components which can be detected to have moved from a first hold-down position (corresponding to a first sheet stack thickness) to a second hold-down position (corresponding to a second sheet stack thickness), can be used, in conjunction with a sensor which can detect movement (from the first hold-down position to the second hold-down position), to implement selected embodiments of the present invention.

It will also be appreciated from FIGS. 1 through 9 that embodiments of the present invention provide for a sheet stack hold-down device (e.g., sheet stack hold-down device 100 of FIG. 4, 200 of FIG. 7, and 300 of FIG. 9) that can be used, in conjunction with a sensor (e.g., sensor 144, FIG. 4, sensor array 244 of FIG. 7, and sensors 344A–E of FIG. 9) to estimate the thickness of a sheet stack. While sensors described above (e.g., sensor 144 and sensor array 244) have been described as including a light source and a photodetector, other types of sensors can be used. For example, the sensor can be a switch (such as a mercury switch or a proximity switch) that can be cycled (opened or closed) then the sheet stack hold-down device reaches the predetermined second position. In general, any sensor that can detect one or more positions of the sheet stack hold-down device can be used. Further, embodiments of the present invention also provide for an imaging apparatus (e.g., imaging apparatus 10 of FIG. 1) which includes a finishing device (e.g., finishing device 40) having a sheet stack hold-down device that can be used, in conjunction with a sensor, to estimate the thickness of a sheet stack. The finishing device can be integral with the imaging apparatus, or it can be a separate module.

Figure 10:
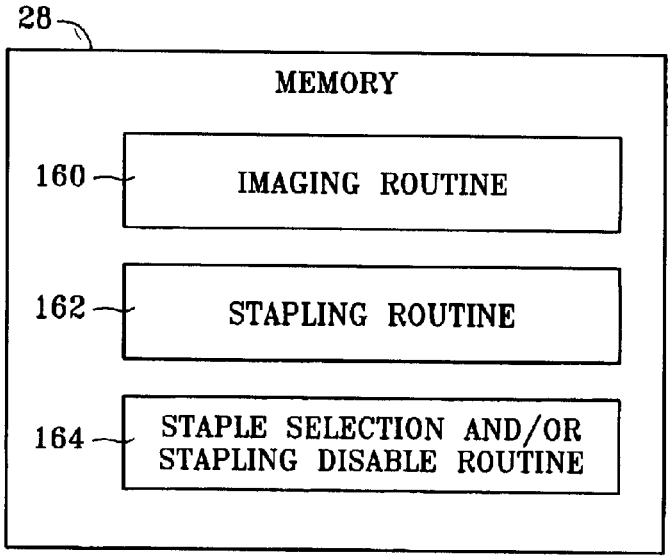
FIG. 10 is a schematic diagram depicting software components that can be used to implement selected methods described herein.

Turning now to FIG. 10, a schematic diagram depicts components of a finishing unit control system which can be used to control the operation of a finishing unit. The finishing unit control system can be used in conjunction with a sheet stack hold-down device (according to any of the embodiments described above, for example) to control a finishing unit. An imaging apparatus (e.g., imaging apparatus 10 of FIG. 1) and/or a finishing device (e.g., finishing device 40 of FIG. 1) in accordance with embodiments of the invention can use the finishing unit control system, which is depicted in FIG. 9 as including a computer readable memory device 28 (as also depicted in FIG. 1) which is readable by a processor (such as processor 26 of FIG. 1). The computer readable memory device 28 can be, for example, a semiconductor memory device component (such as a read-only-memory ("ROM") and/or a random-access-memory ("RAM"), a magnetic memory component (such as a hard drive disk, a diskette or a magnetic tape), and/or or an optical memory component (such as a CD or a DVD). The memory device 28 can have stored therein an "Imaging Routine" 160 which can be used to control the operation of the imaging forming section (22, FIG. 1). The memory device 28 can also have stored therein a finishing unit operation routine which can be executed by the processor (26, FIG. 1). The finishing unit operation routine can use a sheet stack thickness signal (generated by a hold-down device position sensor, such as sensor 144 of FIG. 4, sensor array 244 of FIG. 7, and/or sensors 344A–E of FIG. 9) to cause the processor (e.g., processor 26 of FIG. 1) to control operation of a finishing unit (e.g., finishing unit 44 of FIG. 1). In the example depicted in FIG. 10, the finishing unit operation routine is a "Staple Selection and/or Stapling Disable Routine" 164, which can work in conjunction with a "Stapling Routine" 162, as will now be exemplarily described.

Figure 11:
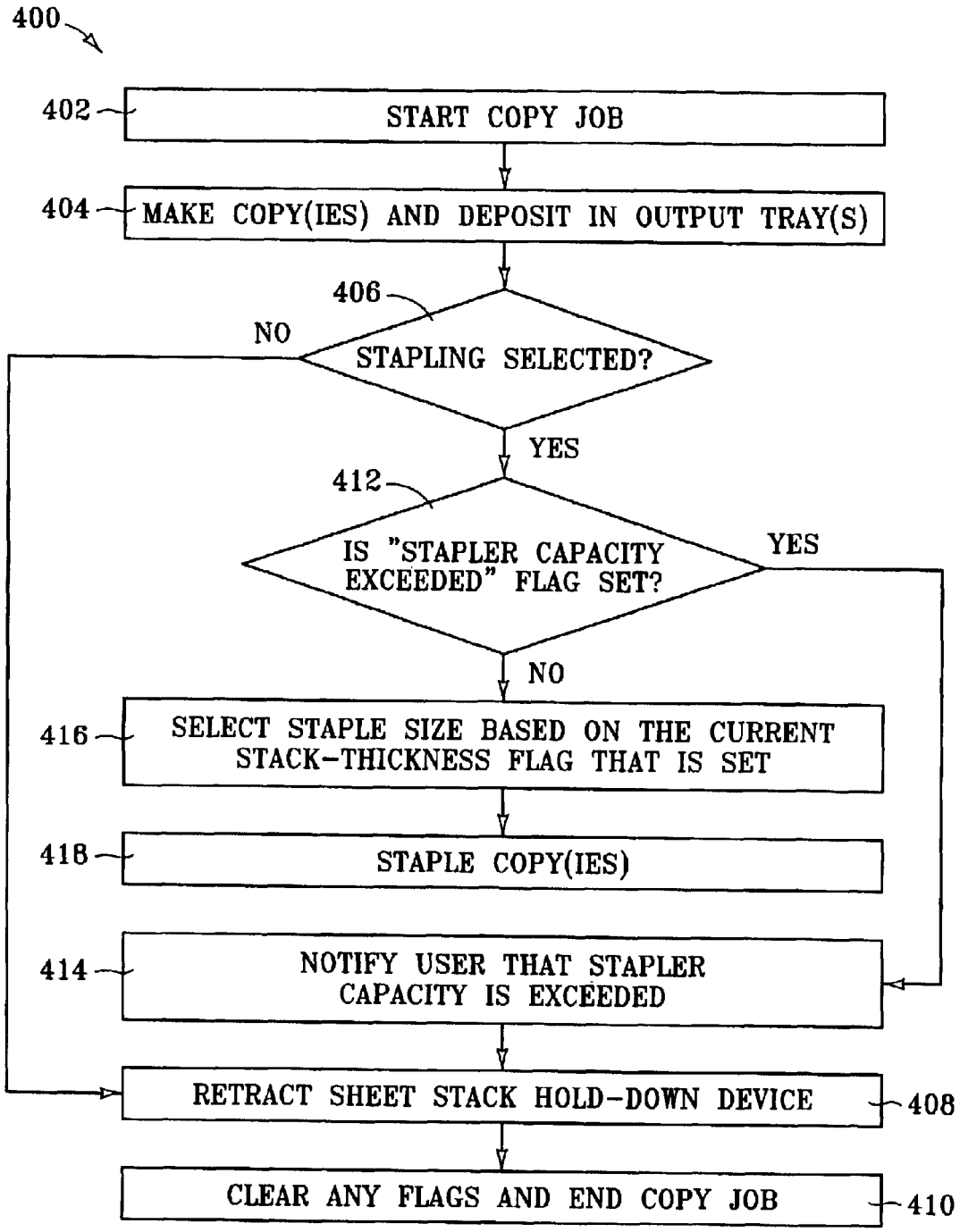
FIG. 11 is a flowchart depicting an example of the staple selection routine of FIG. 10.

Turning to FIG. 11, a flowchart 400 depicts exemplary steps that can be performed by a controller (such as controller 25 of FIG. 1) under the control of a finishing unit operation routine. In the example depicted in FIG. 2, the finishing unit operation routine is the "Staple Selection and/or Stapling Disable Routine" 164 of FIG. 10. The flowchart 400 is also configured on the assumption that the process is being performed by an imaging apparatus (such as imaging apparatus 10 of FIG. 1) under the control of a controller (such as controller 25, FIG. 1). It is further assumed that the imaging apparatus places imaged sheets of media on a sheet stack tray that is provided with a cyclical sheet stack hold-down device, such as the device 100 depicted in FIG. 4. The flowchart 400 (FIG. 11) is based on the further assumption that the imaging apparatus is provided with a finishing device (such as device 40, FIG. 1) having a finishing unit, and that the finishing unit is a stapling unit having variable staple length selectability.

In the flowchart 400, the process begins at step 402 when a copy job is initiated. (It will be appreciated that step 402 can be any type of imaging job, and is not restricted to photocopying.) At step 304, the copies are made (such as by the image forming section 22 of FIG. 1), and the imaged copies are deposited into one or more output trays (such as trays 42 of FIG. 1) to form one or more sheet stacks. At step 406 the controller checks to see if stapling has been selected for the copy job. Stapling can be selected, for example, by a user via a user input station (such as 11 of FIG. 1), which can then cause the controller to enable a stapling routine (such as routine 162 of FIG. 10). The stapling routine can be used to control the stapling unit. Depending on the capabilities of the stapling unit, the stapling routine 162 (FIG. 10) can control such parameters as the location on the sheet stack where the staple is to be placed (e.g., on the edge, at a specific corner, etc.) and the size of the staple to be used. If, a step 406, no stapling has been selected, then the controller proceeds to step 408 and retracts the hold-down device so that the copies can be removed by the user, after which the copy job ends at step 410. However, if at step 406 the controller determines that stapling has been selected, then at step 412 the controller checks to determine whether the stapling unit capacity has been exceeded by checking a designated "flag" (which can be set in a memory location by the processor upon receipt of a signal indicating the flag is to be set). The method of generating a signal to set the flag can be done using the hold-down device and sensor configurations described herein, as for example with respect to FIGS. 4–9, described above.

If at step 412 the controller determines that the stapling unit capacity is exceeded due to the sheet stack thickness, then at step 414 the controller can notify the user (such as by user display 12 of FIG. 1) that the stapling unit capacity has been exceeded. The controller then retracts the hold-down device at step 408, and at step 410 the "Stapler Capacity Exceeded?" flag (checked in step 412) is cleared, and the copy job is ended. However, if at step 412 the "Stapler Capacity Exceeded?" flag is not set (indicating that the stapling unit has the capability to staple the sheet stack), then at step 416 the controller selects the proper staple size (to accommodate the thickness of the sheet stack) based on the current stack-thickness flag that is set. A method for setting different "sheet-thickness" flags was described above with respect to FIGS. 7 and 8. Once the proper staple size has been selected, then at step 418 the controller can cause the stapling unit to staple the sheets stack or stacks. Following the stapling process, the hold-down device is retracted at step 408, the stack-thickness flags are cleared at step 410, and the copy job is terminated.

It will be appreciated that the steps depicted in the flowchart 400 of FIG. 11 are exemplary only, and that additional, fewer, or alternate steps can be used to perform the acts which are included within selected embodiments of methods of the invention. For example, if the stapling unit described with respect to flowchart 400 does not have variable staple-size capability, then step 416 can be deleted. Further, step 408 (wherein the controller retracts the hold-down device) can be eliminated, as for example when the hold-down device does not exert a force on the sheet stack which would inhibit removal of the sheet stack from the tray or damage the hold-down device.

A further embodiment of the present invention provides for a method of controlling operation of a finishing unit (such as finishing unit 40 of FIG. 1). The method includes providing a sheet stack having sheets of imaging media. The sheet stack can be provided, for example, by an imaging section of an imaging apparatus, such as imaging section 20 of FIG. 1. The method also includes holding the sheet stack against a surface (such as sheet stack tray 42 of FIG. 1) with a sheet stack hold-down device (such as hold-down device 100 (FIG. 4), 200 (FIG. 8) or 300 (FIG. 9). The position of the sheet stack hold-down device is then detected (e.g., using the sensor 144 of FIG. 4, sensor array 244 of FIG. 8, or any of sensors 344A–E of FIG. 9). The detected position of the sheet stack hold-down device is then used to control operation of the finishing unit. In one example, the controlling of the finishing unit includes selectively enabling or disabling operation of the finishing unit, as was exemplarily described above with respect to steps 412 and 414 of the flowchart 400 of FIG. 11.

Another embodiment of the invention provides for a finishing unit control system for controlling a finishing unit (such as finishing unit 40 of FIG. 1), used in conjunction with a sheet stack hold-down device configured to contact the sheet stack (such as hold-down device 100, 200 or 300 of respective FIGS. 4, 8 and 9). The finishing unit control system includes a sensor which can detect the position of the sheet stack hold-down device when the sheet stack hold-down device contacts the sheet stack, and generate a signal in response to the detected position of the sheet stack hold-down device. Exemplary sensors that can be used include sensor 144 of FIG. 4, sensor array 244 of FIG. 8, or any of sensors 344A–E of FIG. 9. The control unit further includes a processor (e.g., processor 26 of FIG. 1) that is configured to receive the signal from the sensor, and to control the finishing unit in response thereto. In one example, the sensor is positioned to detect the position of the sheet stack hold-down device only when the sheet stack hold-down device is at or beyond a predetermined position. This example is depicted in FIGS. 4 and 6, wherein in FIG. 4 the light source 146 from the sensor 144 is not blocked by the arm 116 of the hold-down unit 100, but in FIG. 6, when the sheet stack thickness is at "$T_{max}$", the arm 116 (now at the "predetermined position") blocks the light source 146, thus allowing the sensor 144 to detect the hold-down device. The control unit can also include a computer readable memory device (e.g., memory device 28 of FIGS. 1 and 10) which is readable by the processor (e.g., processor 26 of FIG. 1). A finishing unit control routine can be stored in the memory device and executable by the processor. One non-limiting example of a finishing unit control routine is the "Staple Selection and/or Stapling Disable Routine" 164 of FIG. 10, described above. The finishing unit control routine can use the signal generated by the sensor to cause the processor to control operation of the finishing unit. One non-limiting example of the finishing unit control routine using the signal to cause the processor to control the finishing unit was depicted in the flowchart 400 of FIG. 11.

The finishing unit control system can further include a plurality of sensors which can selectively detect the position of the sheet stack hold-down device when the sheet stack hold-down device contacts the sheet stack. One example of this configuration is depicted in FIGS. 7 and 8, wherein the photodetectors 150A–Q of sensor array 244 can be progressively blocked from the respective light sources 246A–Q by arm 216. Based on the photodetector(s) 250A–Q blocked by the arm 216, the sensor array 244 can generate a unique signal, thus allowing the processor (26, FIG. 1) to selectively detect the position of the arm. In this example, the processor (26, FIG. 1) can use the unique signal to selectively control the finishing device, as was exemplarily described with respect to step 416 of the flowchart 400 of FIG. 11.

What is claimed is:

1. A finishing device configured to receive sheets of imaging media, forming a sheet stack, from an imaging apparatus, comprising:

a sheet stack tray configured to support the sheet stack;

a sheet stack hold-down device which is operable from a first position to a variable second position, and when in the second position the sheet stack hold-down device presses the sheet stack against the sheet stack tray; and a plurality of sensors cooperatively configured to provide a variable sheet stack thickness signal corresponding to the variable second position of the sheet stack hold-down device.

2. The finishing device of claim 1, and further comprising a finishing unit configured to apply a post-imaging finishing process to the sheet stack, and wherein the variable sheet stack thickness signal is used to selectively control the finishing unit.

3. The finishing device of claim 2, and wherein the finishing unit comprises one of a stapling unit, a stitching unit, a hole punch unit, or an edge binding unit.

4. The finishing device of claim 3, and wherein the variable sheet stack thickness signal is used to selectively disable operation of the finishing unit.

5. The finishing device of claim 3, and wherein the finishing unit is variably operable, and further wherein the variable sheet stack thickness signal is used to selectively variably operate the finishing unit.

6. The finishing device of claim 3, and further comprising a processor configured to use the variable sheet stack thickness signal to control operation of the finishing unit.

7. The finishing device of claim 6, and further comprising:

a computer readable memory device which is readable by the processor;

a finishing unit operation routine which is stored in the memory device and executable by the processor, and which uses the variable sheet stack thickness signal to cause the processor to control operation of the finishing unit.

8. The finishing device of claim 1, and wherein each of the plurality of sensors comprises a light source and a photodetector, and wherein each photodetector can be blocked by the sheet stack hold-down device when the sheet stack hold down device is in a predetermined position of the variable second position.

9. The finishing device of claim 8, and wherein the sheet stack hold down device comprises a pad configured to press against the sheet stack, and an arm which supports the pad, and wherein one of the pad or the arm blocks at least one photodetector when the sheet stack hold down device is in the predetermined position.

10. The finishing device of claim 8, and wherein each of the photodetectors is progressively blocked by the sheet stack hold-down device when the sheet stack hold down device is moved through the variable second position.

11. The finishing device of claim 8, and wherein the sheet stack hold down device comprises a pad configured to press against the sheet stack, an arm which supports the pad, an actuator which is configured to selectively move the hold-down device between the first and second positions, and at least one connecting link connecting the actuator to the arm, and wherein one of the pad, the arm, the actuator, or the connecting link blocks at least one photodetector when the sheet stack hold down device is in the predetermined position.

12. The finishing device of claim 8, and wherein the sheet stack hold down device comprises a pad configured to press against the sheet stack, an arm which supports the pad, and an extension member connected to the arm, and wherein the extension member the blocks at least one photodetector when the sheet stack hold down device is in the predetermined position.

13. An imaging apparatus configured to generate images on sheets of imaging media, comprising:

a sheet stack tray configured to receive the sheets of media into a sheet stack;

a sheet stack hold-down device which is operable from a first position to a variable second position, and when in the second position the sheet stack hold-down device presses the sheet stack against the sheet stack tray;

a sensor array which detects the position of the sheet stack hold-down device when it is in the second position, to thereby determine the approximate thickness of the sheet stack, and generate a variable stack thickness signal in response thereto; and a finishing unit configured to be controlled by the variable stack thickness signal.

14. The imaging apparatus of claim 13, and wherein the sensor array includes plurality of sensors, each said sensor comprising a light source and an associated photodetector, and wherein the photodetectors are progressively blocked by the sheet stack hold-down device when the sheet stack hold down device is moved through the variable second position to thereby generate the variable stack thickness signal.

15. The imaging apparatus of claim 14, and wherein the finishing unit comprises a stapler configured to provide a staple of variable length for stapling the sheet stack, and wherein the variable stack thickness signal is used to select the staple length.

16. The imaging apparatus of claim 13, and further comprising:

a processor configured to use the variable sheet stack thickness signal to control operation of the finishing unit;

a computer readable memory device which is readable by the processor;

a finishing unit operation routine which is stored in the memory device and executable by the processor, and which uses the variable stack thickness signal to cause the processor to control operation of the finishing unit.

17. The imaging apparatus of claim 16, and further comprising a user display, and wherein:

the processor is further configured to send messages to the user display;

the variable sheet stack thickness signal is used to selectively disable the finishing unit; and when the variable sheet stack thickness signal is used to disable the finishing unit, the processor sends a message to the user display.

18. A method of controlling operation of a finishing unit, comprising:

providing a sheet stack comprising sheets of imaging media;

holding the sheet stack against a surface with a sheet stack hold-down device;

detecting the position of the sheet stack hold-down device using a sensor array;

generating a variable sheet stack thickness signal in response to the detecting; and using the variable sheet stack thickness signal to control operation of the finishing unit.

19. The method of claim 18, and wherein control of the finishing unit comprises selectively enabling or disabling operation of the finishing unit.

20. The method of claim 19, and further comprising operating the finishing unit when the detected position of the sheet stack hold-down device is a position other than a predetermined position.

21. The method of claim 20, and further comprising signaling a user when the operation of the finishing unit is disabled.

22. A finishing unit control system for controlling a finishing unit, used in conjunction with a sheet stack hold-down device configured to contact the sheet stack, comprising:

a sensor array configured to detect the position of the sheet stack hold-down device when the sheet stack hold-down device contacts the sheet stack, and generate a variable signal in response to the detected position of the sheet stack hold-down device; and a processor configured to receive the variable signal, and to control the finishing unit in response thereto.

23. The finishing unit control system of claim 22, and wherein the sensor array is positioned to detect the position of the sheet stack hold-down device only when the sheet stack hold-down device is at or beyond a predetermined position.

24. The finishing unit control system of claim 22, and wherein the sensor array includes a plurality of sensors which selectively detect the position of the sheet stack hold-down device when the sheet stack hold-down device contacts the sheet stack, and wherein each sensor can generate a unique signal in response to the detected position of the sheet stack hold-down device, and wherein the variable signal corresponds to one or more of the unique signals.

25. The finishing unit control system of claim 22, and further comprising:

a computer readable memory device which is readable by the processor; and a finishing unit control routine which is stored in the memory device and executable by the processor, and which uses the variable signal to cause the processor to control operation of the finishing unit.

26. An apparatus for determining an approximate thickness of a sheet stack, comprising:

a sheet stack hold-down means configured to hold the sheet stack against a surface when the sheet stack hold-down means is in a hold-down position, the hold-down position being related to the approximate thickness of the sheet stack; and a sensing means configured to detect the hold-down position of the sheet-stack hold-down means, to thereby provide a variable sheet stack thickness signal corresponding to the detected position of the sheet-stack hold down means.

27. The apparatus of claim 26, and further comprising a finishing means configured to provide a finishing process to the sheet stack, and wherein the finishing means is selectively operable in accordance with the sheet-stack thickness signal.

28. The apparatus of claim 27, and further comprising a control means configured to selectively operate the finishing means in accordance with the sheet stack thickness signal.

29. An apparatus for determining an approximate thickness of a sheet stack, comprising:

means for holding the sheet stack against a surface in a hold-down position, the hold-down position being related to the approximate thickness of the sheet stack; and means for detecting the hold-down position of the means for holding the sheet stack against the surface, to thereby provide a variable thickness signal corresponding to the approximate thickness of the sheet stack.

* * * * *